US011021943B2

(12) United States Patent
Min et al.

(10) Patent No.: US 11,021,943 B2
(45) Date of Patent: Jun. 1, 2021

(54) IGNITION DEVICE FOR UNDERGROUND COAL GASIFICATION PROCESS, AND APPLICATIONS THEREOF

(71) Applicant: ZHONGWEI (SHANGHAI) ENERGY TECHNOLOGY CO. LTD, Shanghai (CN)

(72) Inventors: Zhenhua Min, Shanghai (CN); Yuanli Wang, Shanghai (CN); Casper Jan Hendrik Burger, Shanghai (CN)

(73) Assignee: ZHONGWEI (SHA GHAI) ENERGY TECHNOLOGY CO. LTD, Shanghai (CN)

( * ) Notice: Subject to any disclaimer, the term of this patent is extended or adjusted under 35 U.S.C. 154(b) by 56 days.

(21) Appl. No.: 16/327,729

(22) PCT Filed: Aug. 24, 2016

(86) PCT No.: PCT/CN2016/096486
§ 371 (c)(1),
(2) Date: Feb. 22, 2019

(87) PCT Pub. No.: WO2018/035734
PCT Pub. Date: Mar. 1, 2018

(65) Prior Publication Data

US 2019/0186251 A1 Jun. 20, 2019

(51) Int. Cl.
*E21B 43/295* (2006.01)
*E21B 43/1185* (2006.01)
(Continued)

(52) U.S. Cl.
CPC ..... *E21B 43/295* (2013.01); *E21B 19/22* (2013.01); *E21B 43/1185* (2013.01);
(Continued)

(58) Field of Classification Search
CPC .. E21B 43/243; E21B 43/295; E21B 43/1185; E21B 43/305
See application file for complete search history.

(56) References Cited

U.S. PATENT DOCUMENTS 8,733,437 B2 * 5/2014 Ware ..... E21B 43/2406 166/246
10,711,587 B2 * 7/2020 Burger ..... E21B 43/168
2014/0332218 A1 * 11/2014 Castrogiovanni ..... E21B 43/243 166/302

FOREIGN PATENT DOCUMENTS

AU 2015100786 A4 7/2015
CN 102635346 A 8/2012
(Continued)

OTHER PUBLICATIONS

International Search Report; PCT/CN2016/096486; dated May 22, 2017.

*Primary Examiner* — Catherine Loikith
(74) *Attorney, Agent, or Firm* — Dunlap Bennett & Ludwig, PLLC; Brendan E. Squire

(57) ABSTRACT

An ignition device for an underground coal gasification process, and an underground coal gasification method for carrying out ignition. The ignition device comprises a conveying device, a cut-off device (7), an ignition detonator (6) and one or more fuel packs (5), sequentially connected. The fuel packs are serially connected with each other. The conveying device is a coiled tubing/conjugation tube (12), or an integrated signal cable (21). The ignition detonator runs through one or more fuel packs and ignites the one or more fuel packs starting from the top of the device in a delayed manner. The cut-off device breaks off after the ignition detonator is started, so that ignition device components comprising the conveying device are at least withdrawn to a safe position. Each fuel pack comprises thermite and is used
(Continued)

for igniting an underground coal seam (1) after the fuel pack is ignited.

8 Claims, 4 Drawing Sheets

(51) Int. Cl.

| | |
|---|---|
| ***E21B 43/243*** | (2006.01) |
| ***E21B 19/22*** | (2006.01) |
| ***E21B 43/248*** | (2006.01) |
| ***E21B 43/30*** | (2006.01) |

(52) U.S. Cl.
CPC ..... *E21B 43/243* (2013.01); *E21B 43/248* (2013.01); *E21B 43/305* (2013.01)

(56) References Cited

FOREIGN PATENT DOCUMENTS

| | | | |
|---|---|---|---|
| CN | 103380266 | A | 10/2013 |
| CN | 205243496 | U | 5/2016 |
| CN | 106121619 | A | 11/2016 |
| CN | 206053929 | U | 3/2017 |
| WO | 2008121782 | A1 | 10/2008 |
| WO | 2014089603 | A1 | 6/2014 |

* cited by examiner

IGNITION DEVICE FOR UNDERGROUND COAL GASIFICATION PROCESS, AND APPLICATIONS THEREOF

TECHNICAL FIELD

This invention provides an ignition device for the underground coal gasification process and the applications for igniting the coal during the underground coal gasification process.

BACKGROUND ART

Underground coal gasification (UCG or ISC) is a process by which a coal seam is converted into a product gas (also known as raw syngas), by combusting and gasifying the coal in-situ in the presence of an oxidant. The product gas can be used as a feedstock for various applications, including fuels production, chemicals production and power generation. The underground coal gasification technology is suitable for most coal reserves and is undoubtedly very attractive, since the environmental requirements for the mining industry becoming increasingly strict, and considering relevant labour costs and construction costs.

During the underground coal gasification process, a subsurface completed well system is generally set up in the coal seam. The above mentioned completed well system includes the injection well used for injecting a variety of agents such as oxidant (e.g. air, oxygen-enriched air or pure oxygen), gasification agent and coolant (water, steam and carbon dioxide can be used as both gasification agent and coolant simultaneously; air can also be used as a coolant), the production well for transporting product gas and other support wells; wherein casing and/or well liner are generally installed inside the injection well, production well and other support wells to connect to each other, wherein the above mentioned support wells can include an ignition well, a coolant delivery well, monitoring well and a guard well The injection well is generally a horizontal directional well while the production well and the support wells can generally be either horizontal directional wells or vertical wells.

Therefore, during the underground coal gasification process, the basic completed well system consists of an injection well and a production well, linked and provided with casing and/or a well liner. This is typically referred to as an underground coal gasification unit or well pair.

During the underground coal gasification process, the relevant subsurface zones include the combustion zone, gasification zone and the pyrolysis zone, wherein: the combustion zone is in close proximity to the oxidant and gasification agent injection point, and coal is combusted and gasified in the presence of the oxidant inside the combustion zone; the gasification zone is located downstream of the combustion zone or radially around the combustion zone, and coal is gasified and partially oxidized to produce product gas in the gasification zone; the pyrolysis zone is located downstream of the gasification zone, and the pyrolysis reactions of coal occurs in the pyrolysis zone. The pyrolysis reaction of coal is generally not expected for a well-controlled underground coal gasification process. As coal is consumed or gasified, an underground coal gasification cavity within the coal seam develops and grows in size. This represents a gradual progression of the underground coal gasification process, until the subsurface coal reserve is completely consumed, leaving only ash within the coal seam.

During the underground coal gasification process, the product gas usually consists of CO, $CO_2$, $H_2$, $CH_4$ and solid particles, water, coal tar and hydrocarbons, and small amounts of $H_2S$, $NH_4$ and COS, etc. The actual composition of the above-mentioned product gas is dependent on multiple factors, including the oxidant (e.g. air, oxygen-enriched air, or pure oxygen), presence of water (coal seam water or ingress water into coal seam from the surrounding strata), coal quality, and the process operating parameters (temperature, pressure, etc.).

In order to ignite a coal seam for initiating the underground coal gasification process, coal needs to be heated up to its ignition temperature in the presence of oxidant (air, oxygen-enriched air or pure oxygen). The typical glow point ignition temperatures for various coal types (lignite, bituminous coal, anthracite, up to coke/carbon) generally ranges from 400-700° C. When the oxidant is sufficient and the temperature reaches the point of ignition, coal will be able to sustain the combustion/gasification process without requiring an external heat source, by consuming the coal itself as the fuel source.

Therefore, during the ignition phase of the underground coal gasification process, fuel, heat and oxidant are required for in-situ coal ignition and to sustain combustion, wherein the coal itself can be used as fuel; the initial heat is usually from external sources including the combustion heat from these external ignition fuels; and the oxidant such as air or oxygen is also introduced from external sources.

During the underground coal gasification process, it is very important to ignite the in-situ coal seam safely and efficiently, while maintaining the integrity of the whole well system. However, in prior art, there are still a number of issues to be improved upon for the underground coal gasification ignition process.

In particular, in terms of fuel, the ignition fuels commonly used in prior art such as triethylborane (TEB, $(C_2H_5)_3B$) or silane ($SiH_4$) or a mixture of those with methane, ethane and propane etc. are reactive and auto-ignite when exposed to air or oxygen, thereby they are not safe for general use. Partings that may exist in the subsurface coal seam are also not favourable to coal seam ignition; in terms of heat, the injection well liner and/or casing may have an impact on focusing the initial heat onto the target coal seam during the ignition process, wherein a wet coal seam requires even more heat to evaporate water and thereby making it more difficult to ignite. The temperature of the production well needs to be maintained during the ignition process to prevent coal volatile matter and coal pyrolysis products from condensing (such as coal tar and bitumen), resulting in production well blockages. Furthermore, the introduction and usage of oxidant, as well as the selection and configuration of this equipment, have problems and defects.

Therefore, it is definitely beneficial to further improve the ignition fuel to provide more initial heat and further improve or optimize the well system configuration to fully utilize the increased initial heat.

WO2014/089603A1 disclosed equipment used for ignition of an underground coal seam, as shown in the current art, FIG. 1, wherein the ignition device is a mixing chamber 40 between the inlet 15 and the outlet 17, where the mixing chamber comprises of the ignition fuel and oxidant, and the ignition fuel can be a hydrocarbon gas such as methane, propane, butane and the like, and the oxidant can be air, oxygen-enriched air, a gas mixture rich in oxygen or pure oxygen, the ignition equipment further comprises a combustible burner nozzle 35, where the combustible burner nozzle itself is combustible and may further comprise of thermite, with the aim to facilitate ignition of the coal seam through combustion or exothermic reaction heat release. The ignition is realized mainly by the oxygen combustion of the hydrocarbons in this patent. Although a thermite agent is utilized to promote hydrocarbon combustion, the fuel and heat supply in the ignition stage of the underground coal gasification process are not fully solved.

In regards to the prior art, this invention further improves the ignition of the underground coal gasification process and the ignition device, and particularly, the fuel for the ignition device and the heat supply during the ignition process are improved, thereby improving ignition of the subsurface coal seam.

SUMMARY OF INVENTION

In regards to the prior art, this invention provides the ignition device for the underground coal gasification process, as well as the applications of the ignition device during the ignition stage of the underground coal gasification process.

This invention provides the ignition device for the underground coal gasification process, wherein the ignition device comprises of sequentially connected components, including a delivery device, a disconnect (cut-off) device, an igniter fuse (detonator) device and one or more fuel packs, wherein the fuel packs are connected in series with each other, and wherein:

The above-mentioned delivery device is coiled tubing, jointed (conjugated) tubing or wireline (integrated signal) cable;

The above-mentioned igniter fuse device is connected into one or more fuel packs and is used for igniting the fuel packs from the tip of the ignition device with the delayed activation method;

The above-mentioned disconnect device is used to decouple the rest of the ignition device after the igniter fuse device is initiated. The rest of the ignition device, including the delivery device, is retracted to the minimum safe distance; and The above-mentioned fuel pack contains aluminothermic agent and is used for igniting a subsurface coal seam. The aluminothermic agent is a granular mixture of aluminium powder and a metal oxide capable of undergoing aluminothermic reaction. The metal oxide can be selected from ferric oxide, ferro ferric oxide, copper oxide, nickel dioxide, nickel oxide, vanadium pentoxide, chromium sesquioxide and manganese dioxide, preferably ferric oxide and ferro ferric oxide, wherein the mixture ratio of the aluminium powder to the metal oxide is 0.5-2.0, preferably 0.7-1.5, and more preferably 0.8-1.2 times the stoichiometric ratio of the aluminothermic reaction, wherein the amount of thermite is sufficient to provide an ignition time of 20 seconds to 10 minutes, preferably 30 seconds to 7 minutes.

The present invention also provides an underground coal gasification method, wherein a well completion system for underground coal gasification is constructed in the subsurface coal seam. The ignition device of this invention is used for coal ignition, and after successful ignition, the gasification process is started. When the delivery device is coiled tubing or jointed tubing, the internal pathway of coiled tubing or jointed tubing and the annulus between coiled tubing or jointed tubing and the injection well liner is used as oxidant flow path during the ignition stage. When the delivery device is a wireline cable, the annulus between the fuel pack and the injection well liner is sealed by a centralizer device and the injection well liner is used as delivery gas flow path to propel the fuel pack along the well liner and the well liner is also used as the oxidant flow path during the ignition stage.

According to the present invention, the ignition device comprises a delivery device, a disconnect device, an igniter fuse device and one or more fuel packs, wherein the delivery device can accurately deliver and position the fuel pack, the igniter fuse device starts to ignite one or more fuel packs from the tip of the ignition device with the delayed activation method (i.e. starting from a fuel pack located at the device tip or the farthest fuel pack). The disconnect device decouples the ignition device, after activating the igniter fuse device, from the delivery device, thereby retracting the ignition device components to a safe position for further use. The fuel pack is specially designed and can provide enough initial energy to heat the subsurface coal seam to its ignition temperature, thereby igniting the subsurface coal seam.

According to the present invention, in the underground coal gasification method, when a fault occurs during the ignition stage, such as a production well blockage and/or oxygen leakage without igniting the coal seam, or when the coal seam cannot be continuously gasified due to its discontinuity, the ignition device in this invention can be used for re-ignition, including the secondary ignition and multiple ignitions until the coal seam is re-ignited, thereby ensuring the final implementation of the underground coal gasification process.

Therefore, the use of the ignition device in this invention can safely and efficiently ignite the subsurface coal seam to start and/or continue the underground coal gasification process, improving the current technology.

BRIEF DESCRIPTION OF DRAWINGS

This invention will be further described with the Figures, wherein.

In the respective Figures, like reference numerals refer to like parts. In particular. Specifically, the reference numerals involved in the respective Figures have the following meanings.

Figure 1:
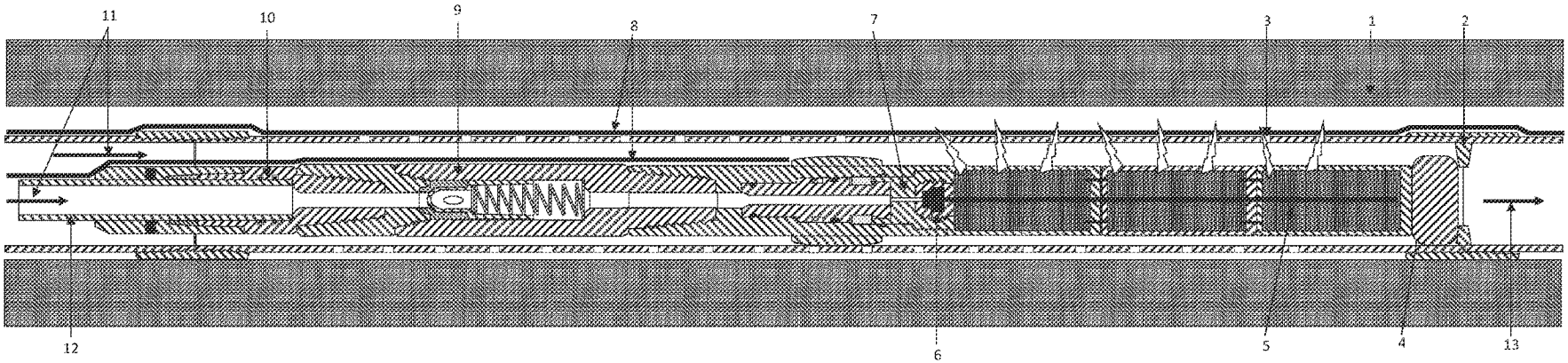
FIG. 1 is a schematic view of one embodiment of this invention where the ignition device is located in the injection well liner, wherein coiled tubing or jointed (conjugated) tubing are used as a delivery device, and the internal pathway of coiled tubing or jointed tubing and the annulus between coiled tubing or jointed tubing and injection well liner is used as oxidant flow path during the ignition phase.

1. Coal seam; 2. Casing coupling (coupling has reduced inner diameter and used as ignition positioning baffle); 3. Injection well liner; 4. Plug (front plug is used for sealing and rear plug is used for centralizing); S. Fuel packs (three fuel packs are connected in series); 6. Igniter fuse (detonator; igniter fuse connects through the three fuel packs); 7. Disconnect (cut-off) device; 8. Distributed temperature, pressure and acoustic sensors (attached onto the outer wall of the injection well liner, and when coiled tubing is used, it is also attached onto the outer wall of the coiled tubing); 9. Check valve (ball and spring type); 10. External grapple connector; 11. Oxidant path; 12 Coiled tubing/jointed tubing; 13. Gasification zone; 14. Injection well casing; 15. Wellhead coolant/air injection port; 16. Wellhead spare coolant injection port; 17. Well control equipment; 18. Coiled tubing reel (instrumentation and data transmission lines are connected inside the central shaft); 19. Swivel joint; 20. Surface oxidant pipelines; 21. Wireline cable; 22. Cable connectors; 23. Centralizer; 24. Wireline service vehicle.

DESCRIPTION OF EMBODIMENTS

This invention provides an ignition device for the underground coal gasification process, as well as the applications of the ignition device during the ignition phase of the underground coal gasification process.

In particular, the present invention provides an ignition device for the underground coal gasification process, wherein the ignition device comprises of a delivery device, a disconnect (cut-off) device, an igniter fuse (detonator) device and one or more fuel packs which are connected in series with each other, and where:

The above-mentioned delivery device is coiled tubing, jointed (conjugated) tubing or wireline (integrated signal) cable;

The above-mentioned igniter fuse device is passes through one or more fuel packs and is used for igniting the fuel packs from the tip of the ignition device with the delayed activation method;

The above-mentioned disconnect device is used to decouple the rest of the ignition device, including the delivery device to the minimum safe position, after activating the igniter fuse device; and The above-mentioned fuel pack contains aluminothermic agent and is used for igniting a subsurface coal seam. The aluminothermic agent is a granular mixture of aluminium powder (aluminum) and a metal oxide capable of undergoing aluminothermic reaction. The metal oxide can be selected from ferric oxide, ferro ferric oxide, copper oxide, nickel dioxide, nickel oxide, vanadium pentoxide, chromium sesquioxide and manganese dioxide, preferably ferric oxide and ferro ferric oxide, wherein the mixture ratio of the aluminium powder to the metal oxide is 0.5-2.0, preferably 0.7-1.5, and more preferably 0.8-1.2 times the stoichiometric ratio of the aluminothermic reaction, wherein the amount of thermite is sufficient to provide an ignition time of 20 seconds to 10 minutes, preferably 30 seconds to 7 minutes.

According to the present invention, in the above-mentioned ignition device, the delivery device can be coiled tubing or jointed tubing or wireline cable, and the delivery device can accurately deliver and position the fuel pack.

According to the present invention, in the above-mentioned ignition device, when the delivery device is coiled tubing or jointed tubing, both the internal pathway of the coiled tubing or the jointed tubing and the annulus between the coiled tubing or the jointed tubing and the injection well liner can be used as oxidant flow path during the ignition phase.

According to the present invention, in the above-mentioned ignition device, when coiled tubing is used as the delivery device, a high purity oxidant such as pure oxygen can be injected into the subsurface coal seam through the coiled tubing, because the coiled tubing is a highly gas tight component that can avoid potential safety issues using high purity oxidant such as pure oxygen.

As is known in the art, the coiled tubing is usually wound on a coiled tubing reel. During operation, the coiled tubing reel is rotated to inject and retract the coiled tubing. The selection of the coiled tubing and its reel should ensure that the coiled tubing can reach the depth where the coal seam is located and the length of the wellbore inside the coal seam.

According to the present invention, in the above-mentioned ignition device, jointed tubing can also be used as the delivery device. For the cases of not using high purity oxidant, such as air, the use of jointed tubing is a very economical solution. The disadvantage is that the operations of injecting and retracting the jointed tubing in the subsurface coal seam is time consuming and labour intensive.

According to the present invention, in the above-mentioned ignition device, the coiled tubing and the jointed tubing, as the delivery device, can be connected to other components by means of a suitable connection, for example, both can be effectively connected to other components via an external grapple connector. The external grapple connector allows for a non-welded connection with a gas tight seal, whereby other parts of the ignition device can be easily replaced and repaired. In addition, the jointed tubing can also be connected to other components via a threaded connection.

According to the present invention, in the above-mentioned ignition device, when coiled tubing or jointed tubing is used as the delivery device, one or more check valves may be connected between the coiled tubing or the jointed tubing and the disconnect device, which is mainly used for preventing reverse flow of gas from entering the coiled tubing or jointed tubing, thereby keeping the relevant parts of the ignition device clean and provide safety protection when removing or retracting through the wellhead. The check valve can be any type of check valve known to those skilled in the art, for example, it can be spring flapper check valve or ball and spring check valve.

According to the present invention, in the above-mentioned ignition device, when a wireline cable is used as the delivery device, it is generally required to seal the annulus between the fuel pack and the injection well liner by using a centralizer device. Thereby the injection well liner can be used as delivery gas flow path of the fuel pack and the oxidant flow path during the ignition phase. While in the process of delivering the fuel pack, the cable tension can be used to determine whether the fuel pack has reached the designed ignition position. The delivery gas flow rate can be reduced when the fuel pack arrives at the ignition position to avoid excessive cable tension, wherein the wireline cable can be connected to the disconnect device via a cable connector. However, the length of the wireline cable might become a limiting factor.

According to the present invention, in the above-mentioned ignition device, the disconnect device is a self-shearing mechanism that can be activated with a pressure signal or an electrical signal to disconnect the ignition device after initiating the igniter fuse device, whereby the rest of the ignition device components including the delivery device can be retracted to a minimum safe position for subsequent application, thereby reducing equipment losses during underground coal gasification to a certain extent.

According to the present invention, in the above-mentioned ignition device, the igniter fuse device connects through one or more fuel packs, i.e. through all of the fuel packs used. It can be activated with a pressure signal or an electrical signal. It serves to ignite one or more fuel packs starting from the tip of the device with the delayed activation method, wherein the with the delayed activation method to ignite the fuel pack enables to disconnect and retract the rest of the ignition device components including the delivery device to a minimum safe position before the fuel pack is ignited.

As the terms used herein, "start from the tip of the device" refers to starting with a fuel pack that is the closest to the end of the device. In other words, the ignition starts from the furthest fuel pack to the igniter fuse device. Specifically, when a plurality of fuel packs are ignited, the igniter fuse device starts to ignite the fuel pack the closest to the end of the device (which is the fuel pack furthest from the igniter fuse device) and then ignites each fuel pack sequentially.

According to the present invention, in the above-mentioned ignition device, both of the igniter fuse device and the disconnect device can be activated using a pressure signal or an electrical signal. The selection of activation signal is usually determined based on the selected delivery device. The principle of selection is to simplify the operation and control processes.

In particular, when coiled tubing or jointed tubing is used as delivery device, the igniter fuse device and disconnect device are usually independently activated using pressure signals. When using a wireline cable as the delivery device, the igniter fuse device and disconnect device are usually independently activated using electrical signals. When using a pressure signal for activation, the pressure to activate the disconnect device is usually slightly higher than the pressure to activate the igniter fuse device to ensure that those two will be activated in sequence. For example, for the gasification process with an operating pressure at 45 barg, a 47.5 barg pressure can be selected to activate the igniter fuse device and a 50 barg pressure can be selected to activate the disconnect device, respectively. When using an electrical signal for activation, the igniter fuse device and the disconnect device are respectively activated sequentially by two independent electrical signals.

According to the present invention, in the above-mentioned ignition device, a specially designed fuel pack is used to ignite the subsurface coal seam, wherein the fuel pack itself and the fuel contained therein are specifically designed.

According to the present invention, in the above-mentioned ignition device, the fuel pack may be a single fuel pack or a plurality of fuel packs connected in series with each other. The fuel pack contains an aluminothermic agent to ignite the subsurface coal seam after the ignition activation. The shape of the fuel pack generally is required to match the shape of the injection well liner. For example, the shape of the fuel pack can be cylindrical, whose outer diameter matches the inner diameter of the injection well liner to ensure that the fuel pack can be delivered into a predetermined ignition location and be moved freely within the injection well liner.

According to the present invention, in the above-mentioned ignition device, the fuel pack generally requires a high pressure and water proof housing, preferably a metal with a certain strength and capable of being melted by the aluminothermic reaction, more preferably an aluminium housing (aluminium melting point is about 680° C.) to ensure the structural integrity of the fuel pack assembly during the delivery in the injection well liner and can be completely burned away after the fuel packs are ignited. In addition, there are random weak points distributed on the fuel pack housing, such as small holes not completely drilled through which is beneficial to release the potential gases generated during the aluminothermic reaction. Furthermore, after positioning the fuel pack at the ignition position, the fuel pack itself can also serve to block the flow path, so as to force the injected oxidant onto the coal seam for ignition.

According to the present invention, in the above-mentioned ignition device, starting from the tip of the device, a plug for blocking the flow path is equipped at the front end of optionally one or more fuel packs. The rear plug is installed at the back end of one or more fuel packs to centralise the ignition device. The material of the plug is generally carbon steel or a metal with a higher melting point than that for aluminium.

In particular, in the ignition device in the present invention, starting from the tip of the device, a plug for blocking the flow path is equipped at the front end of optionally one or more fuel packs (i.e. the end of the fuel pack located at the farthest position from the igniter fuse device). The material of the plug is generally carbon steel or a metal with a higher melting point than that for aluminium. Thereby, the plug can block the flow path with a longer life than that of the fuel pack itself, to force more injected oxidant to flow into the coal seam for ignition. When using multiple fuel packs, the same plug is installed at the back end of one or more fuel packs to centralise the ignition device (i.e. the end of the fuel pack located at the closest position from the igniter fuse device), thereby allowing the plurality of fuel packs to remain well centralised during the delivery process.

In addition, as already mentioned, when a wireline cable is used as the delivery device, the annulus between the fuel pack and the injection well liner need to be sealed by a centralizer. The centralizer can be equipped on the housing of one or more fuel packs, and/or equipped on the above-mentioned plugs that are used for plugging and centralising so as to seal the annulus between the fuel pack and the injection well liner. Therefore, the injection well liner can be used as fuel pack delivery propellant gas and the oxidant flow path during the ignition stage, wherein the centralizer generally has a low coefficient of friction and the material can be rubber, preferably high-density polyethylene.

As known in the prior art, the thermite is a mixture of aluminium powder and some metal oxides, and when they are ignited, the aluminothermic exothermic reaction occurs to reduce the metal oxide to its metal. The reaction proceeds vigorously and releases a large amount of heat, and the temperature can reach 2000-3000° C. For example, the reaction heat of aluminium and ferric oxide reaction is 945.4 cal/g and the temperature can reach around 2500° C. The thermite mixture itself is very stable and can be safely used and handled.

Therefore, the aluminothermic reaction of thermite is a safe and effective method of generating sufficient heat in a limited volume, thereby enabling reactions that require high temperature and high heat energy. The fuel pack in the present invention is therefore designed based on the characteristics of the thermite.

According to the present invention, in the above-mentioned ignition device, the fuel pack contains an aluminothermic agent which is used to ignite the subsurface coal seam after being activated. The thermite is a mixture of aluminium powder and a metal oxide powder capable of undergoing the aluminothermic reaction. The metal oxide can be selected from the group consisting of iron oxides such as ferric oxide, ferro ferric oxide, nickel oxides such as nickel dioxide, nickel oxide and copper oxide, vanadium pentoxide, chromium sesquioxide, manganese dioxide and the like, preferably ferric oxide and ferro ferric oxide, wherein the mixture ratio of the aluminium powder to the metal oxide is generally determined according to the stoichiometric ratio of the aluminothermic reaction, where a 0.5-2.0 of the stoichiometric ratio can be used, preferably 0.7-1.5, and more preferably 0.8-1.2 times. The amount of the thermite agent can be appropriately selected based on the required ignition time ranging from 20 seconds to 10 minutes, preferably 30 seconds to 7 minutes.

According to the present invention, in the above-mentioned ignition device, the fuel pack could also include a diluent to reduce its burning speed and increase the corresponding combustion time. The diluent may generally be a particulate solid fuel, preferably selected from solid hydrocarbons and carbon powders. The amount of diluent may also be appropriately selected, generally, it cannot exceed 40% by weight of the total mixture weight, preferably not more than 30% by weight, more preferably not more than 25% by weight.

According to the present invention, in the above-mentioned ignition device, the thermite and optional diluent in the fuel pack are both granular materials. The particle size can be appropriately selected based on the required ignition performance, but it is generally preferred to use small particles to increase the combustion efficiency of the fuel pack. For example, the particle size of the thermite and the diluent can each be from 200 nm to 5.0 mm, preferably 300 nm to 4.0 mm, more preferably 500 nm to 2.5 mm.

According to the present invention, in the above-mentioned ignition device, when the fuel pack is ignited, the thermite therein starts the aluminothermic reaction and the optional diluent fuel starts to combust. The heat generated in these reactions are sufficient to burn through the housing of the fuel pack and the injection well liner at the ignition position, evaporate free water in the coal seam at the ignition position, and increase the coal seam temperature to the ignition point, ultimately achieving coal seam ignition.

Therefore, according to the present invention, in the above-mentioned ignition device, the design of the fuel pack can be performed by adjusting the mixing ratio of the aluminium powder to the metal oxide, changing the selection and amount of diluent, and varying the particle size of the thermite and/or diluent, thereby changing the heat release and ignition time of the fuel pack, thereby optimizing the ignition process of underground coal gasification is optimized.

For example, the thermite can be comprised of aluminium powder and ferric oxide at a stoichiometric ratio (i.e. a molar ratio of 2:1), and then is mixed with the carbon powder (the amount of carbon powder is about 15% by weight of the total mixture) and the particle size of the final mixture is controlled at approximately 1 mm. The mixture is then used in the fuel pack in the present invention.

According to experimental measurements, the combustion time of this mixture (6.35 pounds) was about 30 seconds after ignition and released a total heat energy of about 11.4 MJ, which was sufficient to achieve the following effects: melting the aluminium housing of the fuel pack; heating and evaporating 2 feet long free water in the annulus of fuel pack and the injection well liner; melting 3 feet long of aluminium liner; heating 237 $Nm^3/h$ of nitrogen to 650° C.; and heating the coal seam to reach the ignition point of 650° C.

In this case, after combining 10 fuel packs of this size and sequentially igniting one by one, it is possible to provide a combustion time of 5 minutes and a heat energy output of about 114 MJ, which is enough to ignite the subsurface coal seam. This indicates that the fuel pack in this invention can be suitably used to ignite coal seams during the underground coal gasification process.

The present invention also provides an underground coal gasification method, wherein a well completion system for underground coal gasification is constructed in the subsurface coal seam, wherein the ignition device of this invention is used for ignition, and after the ignition is successful, the gasification process is started, wherein when the delivery device is a coiled tubing or a jointed tubing, the internal pathway of coiled tubing or jointed tubing and the annulus between coiled tubing or jointed tubing and injection well liner is used as oxidant flow path during the ignition phase. When the delivery device is a wireline cable, the injection well liner is used as delivery propellant gas flow path for the fuel pack and oxidant flow path during the ignition stage after the annulus between the fuel pack and injection well liner is sealed by centralizers.

According to the present invention, in the above-mentioned underground coal gasification method, the temperature, pressure, and acoustic sensors are attached onto the outer casing of the vertical section of the injection well, the outer wall of the injection well liner, the wellhead of the production well, the outer wall of the production well liner, and the outer wall of the coiled tubing respectively, to measure the subsurface temperature, pressure, and acoustic signals and send feed back to the control system near the wellhead.

According to the present invention, the above-mentioned temperature, pressure and acoustic sensors can be distributed sensor optic fibre based on Optical Time-Domain Reflectometry (OTDR). The optic fibre can extend from the wellhead or the central shaft of coiled tubing reel to the target measuring point, to obtain corresponding temperature profile, pressure profile and acoustic profile. All the measured data are used for monitoring the ignition position, the combustion zone, the subsurface coal seam consumption, the temperature and pressure of the injection well, the production well and the gasification zone and well system integrity etc., thereby controlling the underground coal gasification process. The duplex bimetallic type K thermocouples with metal sheath can be used additionally or alternatively as the temperature sensors.

Specifically, according to the present invention, the functions of the various temperature, pressure, and acoustic wave sensor are described as following: The temperature, pressure, and acoustic sensors attached onto the outer casing of the vertical section of the injection well, outside the wellhead of the production well, the outer wall of the production well liner serve as data sources for the safety protection system. When the temperature is too high and the pressure is too high (e.g. when the temperature and/or pressure at a position reaches a critical value or exceeds the design safety value), the system operation can be automatically shut down, and the control system can respond to relevant problems based on the acoustic signal from these sensors to ensure the integrity of the well system;

The temperature, pressure and acoustic sensors attached onto the outer wall of the injection well liner are generally extended to the gasification zone via the instrument port at the wellhead, and the measurement results are transferred back to the control system and stored in a database, wherein the temperature and pressure sensors are mainly used to monitor temperature and pressure in the subsurface coal seam, temperature at the ignition position and pressure in the gasification zone, and wherein the acoustic wave sensor is mainly used to confirm the ignition location. In general, when the temperature of the gasification zone is >600° C. (e.g. 600-1200° C.), it can be considered that the coal seam is being gasified along the injection well liner. When the temperature is higher than 1,200° C., the main reaction is coal combustion. In addition, when the entire subsurface coal seam along the injection well liner is consumed, the operation system can be shut down automatically;

When coiled tubing is used as the delivery device, the temperature, pressure, and acoustic sensors attached onto the outer wall of the coiled tubing can extend from the centre shaft of the coiled tubing reel all the way down to the oxidant nozzle which may be used. These sensors are connected to wireless transmitter devices and will transfer measurement results back to the control system and stored in the database.

According to the present invention, based on the temperature, pressure and acoustic signal acquisition systems designed as described above, good control of the entire underground coal gasification process including the ignition phase can be achieved.

According to the present invention, for a well completion system designed in the subsurface coal seam, the well liners of a well system (including injection well and production well) can be connected using any suitable connection method commonly used in the art. For example, welding, threading, clamp grooves, flanges, ferrules, or snap-in connections can be adopted as long as it is based on the principle of ensuring the best performance of the final well completion system.

According to the present invention, for the above-mentioned well completion system, the injection well liner is an important component and its functional integrity is an important guarantee for the smooth operation of the underground coal gasification process.

Specifically, the function of the injection well liner is mainly embodied in the following aspects: Firstly, the injection well liner is an important channel for fluid flow and equipment delivery during the underground coal gasification process; Secondly, the annulus between the injection well liner and the open bore hole in the coal seam can also be used as a flow path after being purged with an inert gas. For example, after successful ignition, if the coal seam is very dry and/or the gasification process requires more gasification agent, the extra gasification agent can be injected through the annulus; Furthermore, in order to monitor the subsurface coal seam consumption location and relevant process parameters, the distributed temperature, pressure, and acoustic wave sensors can be attached onto the outer wall of the injection well liner to provide corresponding temperature, pressure, and acoustic profiles.

According to the present invention, the material of the injection well liner can generally be selected according to the lithostatic pressure and hydrostatic pressure of the subsurface formation; the inner diameter of the injection well liner generally needs to match the outer diameter of the fuel pack; the annulus between the inner wall of the injection well liner and coiled tubing or jointed tubing can be used as a flow path, for example as an oxidant flow path during the ignition phase. The injection well liner generally extends near the bottom of the subsurface coal seam and above partings which may be present. In general, the injection well liner is required to be as close as possible to the bottom of the subsurface coal seam, but it cannot exit out of the coal seam into the underlying rock. When partings exist, it shall be located above the partings, and there will be preferably a continuous coal seam of approximately 1 meter thick between the liner and the parting, preferably less than 15 cm thickness for the non-coal layer and more preferably less than 10 cm thickness.

According to the present invention, the injection well liner and the production well liner generally intersect each other at the ends, and both the injection well liner and production well liner are required to be perforated at the intersection to allow product gas to enter the production well liner from the injection well liner, and finally be extracted at the production well.

In this case, for the injection well liner and the production well liner, the lengths of the perforated sections can be 1-3 each, preferably 2 complete tubing lengths, and the diameter of the perforated holes are generally 5-35 mm, preferably 10-25 mm. The perforations are generally arranged in staggered intervals, and the total area of the perforations can be 5-35%, preferably 10-30%, of the total wall area on the perforated sections; In addition, wherein the perforations generally starts at least 0.5 meters away from the coupling to maintain the strength of the entire tubing section.

According to the present invention, wherein a baffle is provided at ignition location in the perforated section of the injection well liner, and under the condition of ensuring that there are perforated well liners on both sides of the baffle, the baffle is preferably set at a distance of 1-2 complete tubing sections from the tip of the injection well liner, to assist in finally locating the fuel pack, wherein the baffle can be a welded baffle or a reduced inner diameter coupling to pre-set the ignition location and assisting in finally locating the fuel pack during operation. After the fuel pack is positioned, it seals the baffle, resulting in blocking of the flow path in front of the baffle and forcing the injected oxidant to flow through the perforation holes on the injection well liner to the coal seam for ignition.

In addition, as mentioned above, the ignition device of the present invention is provided with a plug for blocking the flow path, optionally at the front end of one or more fuel packs, located at the tip of the device. When the baffle is used, the plug will block the flow path in front of the baffle and force the injected oxidant to flow through the perforation holes on the injection well liner onto the coal seam for ignition.

In addition, similar to the prior art for the underground coal gasification process, the well completion system usually includes well flushing, drainage and air drying, wherein the well flushing and drainage include removing drilling cuttings and drilling fluid and pumping free water from the well. Air drying includes injecting air from the injection well and venting or purging the residual water in the production well, and gradually pressurizing it to the target operating pressure and injecting air until ignition to maintain circulation and dry the well system.

According to the present invention, in the underground coal gasification method, ignition and gasification can be further performed as following:

Under the conditions of air injection maintaining the well system circulation and dry, the delivery device starts to deliver one or more fuel packs to the ignition positioning baffle. When the delivery device is a wireline cable, air is used as fuel pack delivery propellant gas;

Injecting air at a low flow rate (e.g. 5300 $Nm^3/h$ of air) through the oxidant flow path, the igniter fuse device is activated to start igniting one or more fuel packs from the tip of the device with a delayed activation method. The disconnect device is then activated in order to retract the rest of the components for the ignition device, including the delivery device, to a minimum safe position, being at least 10 metres away from the ignition position, preferably at least 20 metres;

The temperature at the ignition position and the wellhead of the production well are measured. The air flow is gradually increased (such as gradually increase to S1,000 $Nm^3/h$) after the injection well liner starts melting and until the product gas composition is stable. The air flow is again gradually increased again until the temperature at the wellhead of the production well meets the requirements (e.g. reaches the predetermined value of 120-150° C.). Under the condition that there are no blockages and/or oxygen bypass to the production well, oxidant and gasification agent start to be injected for gasification, wherein if the optical fibre signal indicates that the temperature at the ignition position exceeds the measurable range and the length of the optical fibre becomes shorter, it can be confirmed that the injection well liner begins to melt.

In the above-mentioned method of the present invention, in regards to the temperature at the production wellhead, the heat-up rate of the production well is generally controlled by the oxidant or air flow rate, at a rate of no more than 20° C./h, preferably no more than 15° C./h, and finally the temperature at the production wellhead stabilizes at 120-150° C. The reasons why the temperature at the production wellhead is controlled in this way is to ensure that coal volatiles and coal pyrolysis products can be entrained by the product gas flow to the surface without blocking the production well, after condensation, and without disrupting the integrity of the well system. If blockage occurs at the production well, the ignition process should to be stopped. The oxygen bypass can be monitored based on the oxygen content in the product gas. If oxygen content in the product gas is in the explosion limits, demonstrating that oxygen bypass has occurred, and the ignition should also be stopped at this time.

According to the present invention, in the above-mentioned underground coal gasification method, when using high-purity oxidant with an oxygen concentration higher than 35 vol % during gasification, the coolant is required to be injected at the same time. The annulus between the injection well liner and the open bore hole in the coal seam can be used to inject gasification agent, wherein the annulus generally requires to be purged by inert gas before the ignition process.

According to the present invention, in the above-mentioned underground coal gasification method, re-ignition (including secondary ignition and multiple ignitions) is generally required in the case where the coal seam is not ignited during the ignition phase or the coal seam has discontinuities during the gasification process. Coiled tubing is generally used as the delivery device to reload and transport the fuel packs in place, and it is also used as an oxidant channel to inject oxidants with an oxygen concentration of 35-50 vol % to re-ignite the coal seam. Coiled tubing is used here due to its operational flexibility and more importantly due to it being highly gas tight to guarantee no oxidant leakage.

According to the present invention, in the above-mentioned underground coal gasification method, if a blockage occurs and/or an oxygen bypass occurs at the production well during the ignition process, the ignition process is stopped. Usually, it requires to determine whether the coal seam is ignited, and if it is not ignited, re-ignition is required. Specifically, if an oxygen bypass occurs, the coal seam is generally not fully ignited and usually requires re-ignition; If a production well blockage occurs, e.g. blocked by condensed coal tar, the blockage must be cleared first. Then, it is required to determine whether the coal seam is ignited. If it is ignited, only increasing the oxidant flow to continue ignition is required. If it is not ignited, re-ignition is required. For re-ignition during the ignition process, the use of an oxidant with an oxygen concentration of 35-50 vol % is mainly to ensure that the remaining injection well liner after the previous ignition can be rapidly burned off to ignite the new section of the coal seam.

According to the present invention, in the above-mentioned underground coal gasification method, if the coal seam has discontinuities during the gasification process, for example, when gasification reaches a thick non-coal formation such as a partings, faults, or folds etc., the gasification process does not proceed. It is generally necessary to identify the position of the coal seam for re-ignition, wherein the oxidant with an oxygen concentration of 35-50 vol % is usually used to ensure that the new section of the coal seam can be quickly ignited.

The embodiments of this invention will be further described below with reference to the accompanying figures.

Figure 2:
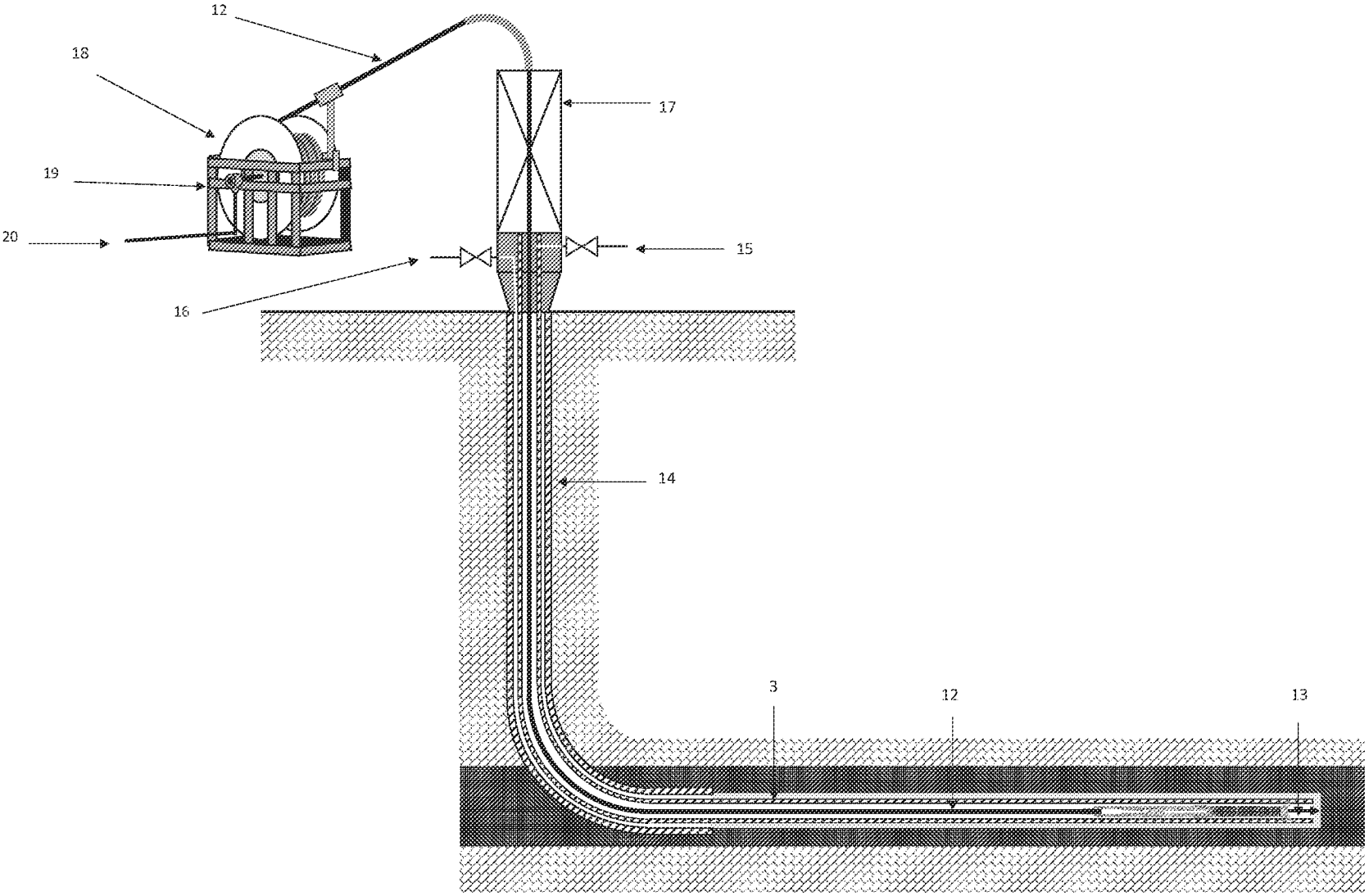
FIG. 2 is the schematic view of the embodiment of the ignition apparatus of the present invention shown in FIG. 1, including the injection well and the surface facilities.

FIGS. 1-2 shows one embodiment of the ignition device in the present invention, wherein a coiled tubing or a jointed tubing is used as the delivery device. As shown in FIGS. 1-2, wherein the coiled tubing or jointed tubing 12 is connected to the check valve 9 through an external grapple connector 10 and is further connected to the igniter fuse device 6 and fuel pack 5 via the disconnect device 7. The distributed temperature, pressure, and acoustic sensors 8 are attached onto the outside of the injection well liner and on the outer wall of the coiled tubing, respectively. The fuel pack 5 contains thermite and diluent. The igniter fuse device 6 penetrates through the fuel pack (3 fuel packs shown in FIG. 1), and firstly ignites the furthest fuel pack with a delayed activation method and then sequentially ignites each fuel pack backwards. Heat is released after the fuel pack is ignited, and air is injected at low flow rate through the oxidant flow path 11 (In this case, it is the annulus between the injection well liner and the coiled tubing or the jointed tubing 10). The low flow rate air entrains heat to enter the coal seam 1 in the surrounding area through the perforation holes on the injection well liner 3 and transfer the heat into the coal seam 1. The plug 4 is installed at the front end of the fuel pack to block the casing coupling 2 in the injection well liner 3 after the fuel pack is positioned (the reduced diameter coupling also serves as a baffle), in order to force the injected low flow rate air through the perforation holes on the injection well liner, to flow into the coal seam for ignition.

Figure 3:
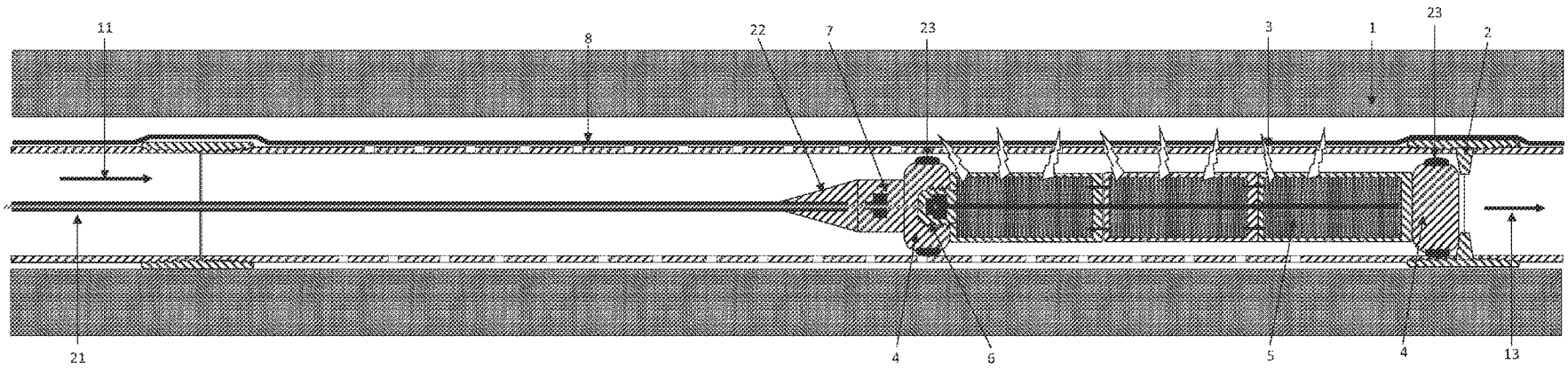
FIG. 3 is the schematic view of another embodiment in this invention for the ignition device located in the injection well liner, wherein the wireline (integrated signal) cable is used as the delivery device, and the annulus between the fuel pack and injection well liner is sealed by centralizers, where the injection well liner is used as delivery gas flow path for the fuel pack and the oxidant flow path during the ignition stage, wherein 3 fuel packs are used in the embodiment with centralizing plugs attached on both sides.
Figure 4:
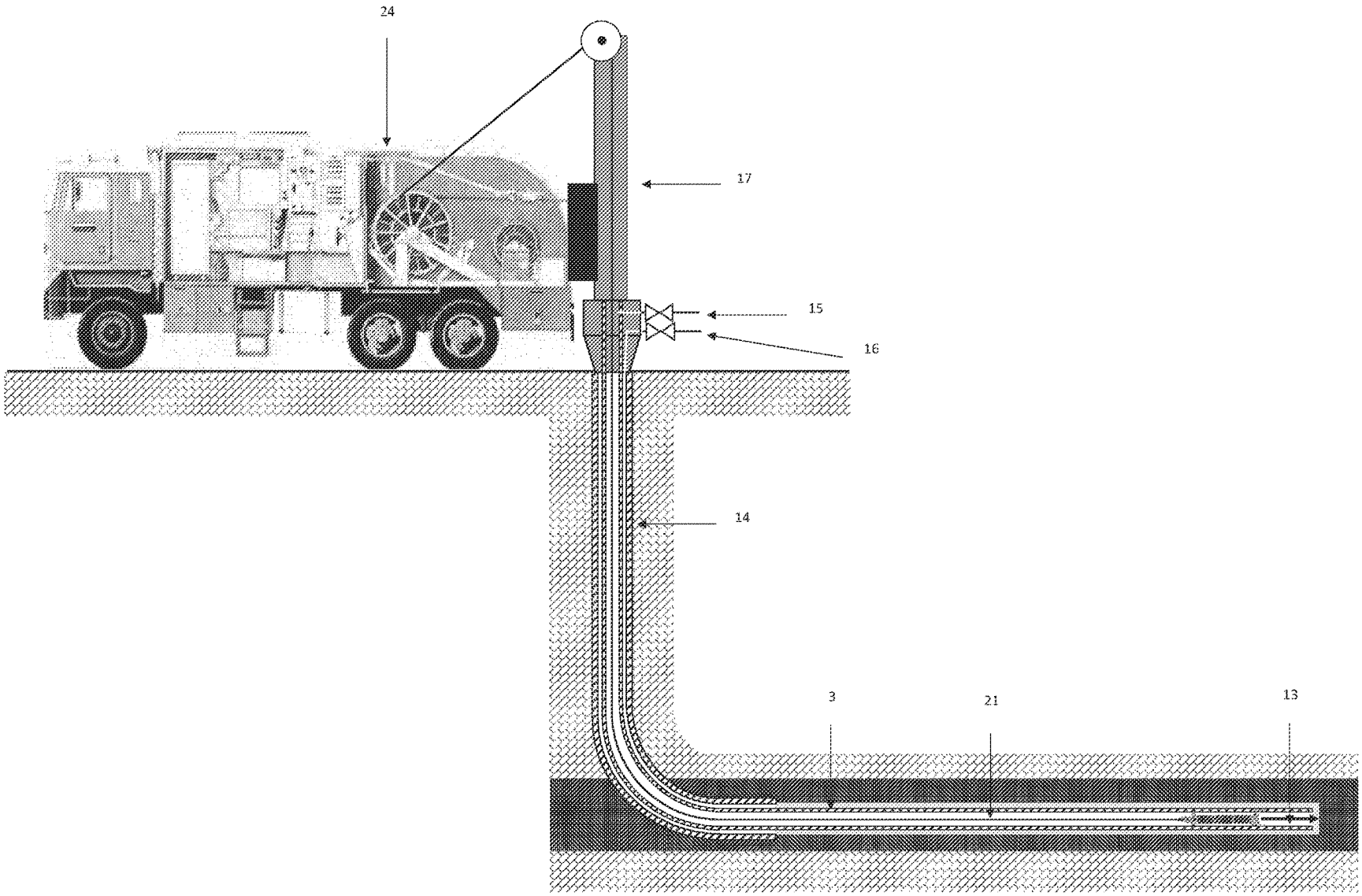
FIG. 4 is the schematic view of the embodiment of the ignition device of the present invention shown as FIG. 3, including the injection well and the surface facilities.

FIGS. 3-4 shows another embodiment of the ignition device of the present invention, wherein a wireline cable is used as the delivery device. As shown in FIGS. 3-4, the wireline cable 21 is connected to the disconnect device 7 and igniter fuse device 6 via a cable connector 22 at its tip, wherein both the disconnect device 7 and the igniter fuse device 6 are activated by electrical signals. The setup and function of the fuel pack 5 in FIG. 3 is the same as in FIG. 1, except that electrical signal is transmitted through the wireline cable 21 to control and initiate the disconnect device 7 and igniter fuse device 6. In addition, the fuel pack 5 must be injected to a pre-determined ignition location by the wireline cable 21 and the delivery propellant air flow through the oxidant flow path 11. The plug 4 for blocking oxidant flow is installed at the front end of the fuel pack, and the plug 4 for centralizing is installed at the tail end of the fuel pack. The centralizer 23 is also sleeved on both plugs to achieve a gas tight seal by keeping close contact with the inner wall of the injection well liner, thereby maximizing the fuel pack propulsive force from the delivery air flow.

The present invention is not limited to the embodiments described above. For those skilled in the art, the invention can also have various changes and modifications without departing from the spirit and principles of the invention. Such variations and modifications are intended to be within the scope of the invention.

The invention claimed is:

1. An ignition device for the underground coal gasification process, wherein the ignition device comprises:

a delivery device, a disconnect device, an igniter fuse device and one or more fuel packs connected in series with each other, wherein:

the delivery device is a coiled tubing, a jointed (conjugated) tubing or a wireline cable;

the igniter fuse device passes through one or more fuel packs and is used for igniting the fuel packs from a tip of the ignition device with a delayed activation method;

the disconnect device is used to decouple a rest of the ignition device after activating the igniter fuse device, thereby retracting one or more ignition device components including the delivery device, thereby, to a minimum safe position; and the fuel pack contains an aluminothermic agent and is used for igniting a subsurface coal seam after activation, wherein the aluminothermic agent is a granular mixture of aluminum powder and a metal oxide capable of undergoing an aluminothermic reaction and the metal oxide can be selected from the group consisting of ferric oxide, ferro ferric oxide, copper oxide, nickel dioxide, nickel oxide, vanadium pentoxide, chromium sesquioxide and manganese dioxide, wherein a mixing ratio of the aluminum powder to the metal oxide is 0.5-2.0 times a stoichiometric ratio of the aluminothermic reaction and an amount of thermite is sufficient to provide a combustion time from 20 seconds to 10 minutes.

2. The ignition device in claim 1, wherein starting from the tip of the device, a plug for blocking a flow path is equipped at a front end of optionally one or more fuel packs, wherein a rear plug is installed at a back end of one or more fuel packs to centralise the ignition device and a material of the plug is carbon steel or other metals whose melting point is higher than that of aluminum.

3. The ignition device in claim 1, wherein a fuel pack housing is generally a metal with a suitable strength and can be melted by the aluminothermic reaction, wherein provisioned random small holes that are not completely drilled through on the fuel pack housing, which is beneficial to release a potential gas generated during the aluminothermic reaction.

4. The ignition device in claim 1, wherein the fuel pack further includes a particulate diluent, selected from the group of solid fuels, preferably selected from solid hydrocarbons and carbon powder, wherein an amount of the particulate diluent to be used cannot exceed 40 wt % of a total mixture weight of the particulate diluent and thermite and wherein a particle size of the thermite and the particulate diluent can each be from 200 nm to 5.0 mm.

5. The ignition device in claim 1, wherein the delivery device is coiled tubing or jointed tubing, wherein the coiled tubing and jointed tubing can be effectively connected to other components via an external grapple connector, which can realize a non-welded connection and a gas tight seal.

6. The ignition device in claim 5, wherein the igniter fuse device and disconnect device can each be activated by a pressure signal, wherein or more check valves can also be connected between the coiled tubing or jointed tubing and the disconnect device, mainly for preventing reverse gas flow into the coiled tubing or jointed tubing.

7. The ignition device in claim 1, wherein the delivery device is wireline cable, the wireline cable is connected to the disconnect device via a cable connector, wherein one or more centralizers are installed on a fuel pack housing and/or one or more plugs for blocking and centralising, if the one or more plugs are installed.

8. The ignition device in claim 7, wherein the igniter fuse device and the disconnect device are each activated by an electrical signal, said centraliser material being rubber comprising high-density polyethylene.

* * * * *